US006595024B1

(12) United States Patent
Tang et al.

(10) Patent No.: US 6,595,024 B1
(45) Date of Patent: Jul. 22, 2003

(54) EXPRESSOR CAPACITY CONTROL

(75) Inventors: Yan Tang, Daphne, AL (US); Joost J. Brasz, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/179,595

(22) Filed: Jun. 25, 2002

(51) Int. Cl.[7] ..... F25B 1/00

(52) U.S. Cl. ..... 62/498; 62/87; 62/228.5; 62/197

(58) Field of Search ..... 62/498, 228.5, 62/197, 116, 87, 402; 418/183, 189

(56) References Cited

U.S. PATENT DOCUMENTS 3,934,424 A * 1/1976 Goldsberry ..... 62/87
4,187,693 A * 2/1980 Smolinski ..... 62/402
4,235,079 A * 11/1980 Masser ..... 62/87
6,185,956 B1 * 2/2001 Brasz ..... 62/498

FOREIGN PATENT DOCUMENTS

JP 359210259 A * 11/1984 ..... 62/228.5

* cited by examiner

*Primary Examiner*—Melvin Jones

(57) ABSTRACT

Saturated or sub-cooled liquid is supplied to the expander of an expressor. Starting just prior to the end of the inlet process or just after the completion of the inlet process, high pressure vapor from the expressor compressor discharge is supplied to the cavity defining a trapped volume under going expansion.

6 Claims, 3 Drawing Sheets

EXPRESSOR CAPACITY CONTROL

BACKGROUND OF THE INVENTION

All closed refrigeration systems serially include a compressor, a condenser, an expansion device and an evaporator. Expansion devices include fixed orifices, capillaries, thermal and electronic expansion valves, turbines, and expander-compressors or expressors. In each of the expansion devices, high pressure liquid refrigerant is flashed as it goes through a pressure drop with at least some of the liquid refrigerant becoming a vapor causing an increase in specific volume. In an expressor, the volumetric increase is used to power a companion compressor which delivers high pressure refrigerant vapor to the discharge of the system compressor thereby increasing system capacity. Since the compression process occurring in the expressor is not powered by an electric motor, but by the flashing liquid refrigerant, overall refrigeration efficiency increases by the same amount as the system capacity.

For a typical applied pressure ratio for chillers, the pressure ratio, Pr, which represents the ratio of the discharge pressure to the suction pressure, is used to control the system. The volume ratio, $V_i$, is the ratio of the suction volume to discharge volume in the case of compression and the ratio of the discharge volume to suction volume in the case of expansion. For liquid expansion, the $V_i$, is on the order of ten, or more. For the same pressure ratio, the $V_i$ for vapor expansion is only around three or four. The reason for the disparity between liquid and vapor expansion is that the volume of vapor is about eighty times that of the corresponding amount of liquid under the same conditions of temperature and pressure. Additionally, the phase change requires energy to convert the liquid to vapor. If an expander has a very high $V_i$, e.g. ten, or above, at the end of the inlet process liquid will fill the cavity defining the trapped volume of the expander. The expander will not be able to function properly in the absence of flashing, i.e. sub-cooled liquid, or if the flash rate does not match up with the volume change since liquids are not expandable. Prior art devices employ pre-throttling to significantly reduce the $V_i$, or Pr for the expander. Accordingly, at the end of the inlet process there are two phases inside the cavity volume. Pre-throttling wastes power in that no use is made of the energy.

SUMMARY OF THE INVENTION

A rotary vane or twin screw expander-compressor, or expressor, unit is used as an expansion device for achieving phase changing in air conditioning and refrigeration systems. The rotary vane, or twin screw, expressor is, effectively a two stage device with the expander being the first stage and providing the power for driving the compressor which is the second stage and which delivers compressed high pressure refrigerant to the discharge line extending from the system compressor to the condenser. According to the teachings of the present invention, liquid refrigerant is supplied to the inlet of the expander. At the end of the inlet process, high pressure vapor from the expressor compressor discharge is supplied to the trapped volume. This allows the expander to function properly while permitting the mechanical power of the liquid-to-vapor expansion to be fully derived. At start up some of the hot high pressure gas from the discharge line is supplied directly to the expander of the expressor which is thereby caused to start rotating.

It is an object of this invention to provide a high efficiency expansion of saturated or sub-cooled liquid to its vapor so as to derive mechanical power.

It is another object of this invention to control the rotational speed or flow capacity of an expresser.

It is an additional object of this invention to supply discharge gas directly to the expander of the expressor during start up.

It is a further object of this invention to eliminate the need for pre-throttling the liquid being supplied to the expander of an expressor. These objects, and others as will become apparent hereinafter, are accomplished by the present invention.

Basically, saturated or sub-cooled liquid is supplied to the expander of an expressor. Starting just prior to the end of the inlet process or just after the completion of the inlet process, high pressure vapor from the expresser compressor discharge is supplied to the cavity defining a trapped volume under going expansion.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
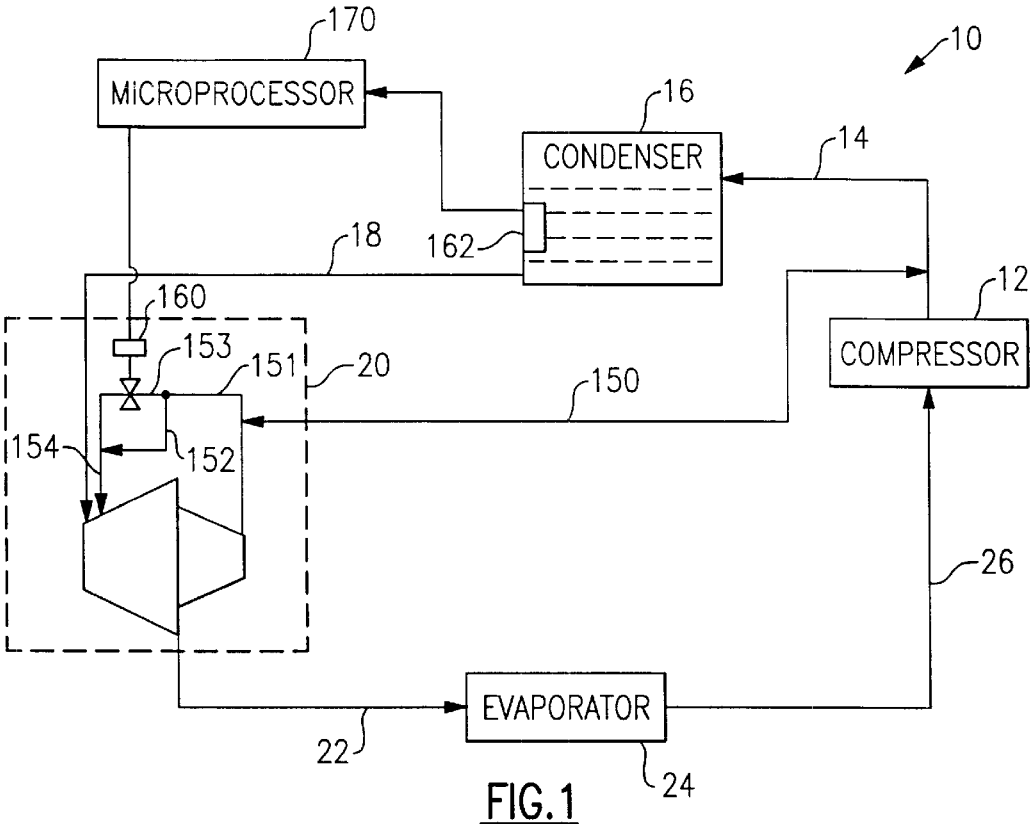
FIG. 1 is a schematic representation of a refrigeration or air conditioning system employing the present invention.
Figure 2:
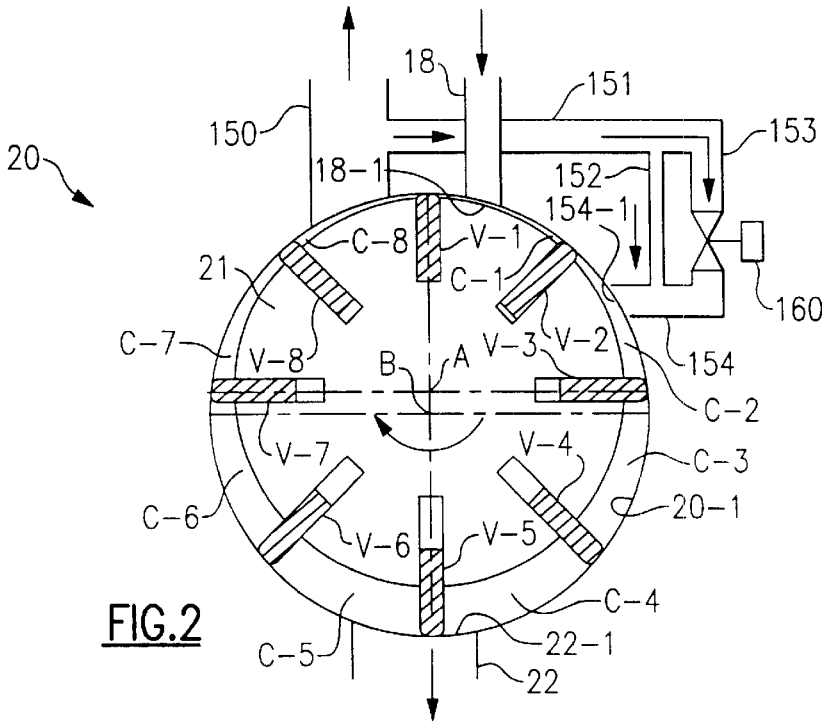
FIG. 2 is a simplified representation of the expressor of the FIG. 1 system where the expressor is a rotary vane device.

In FIG. 1, the numeral 10 generally indicates a refrigeration or air conditioning system. Starting with compressor 12, the system 10 serially includes discharge line 14, condenser 16, line 18, an expansion device in the form of expressor 20, line 22, evaporator 24 and suction line 26 completing the circuit. Referring to FIG. 2, the expressor 20 is illustrated as a rotary vane device which functions for, nominally, half of each rotation as an expander and for, nominally, half of each rotation as a compressor so that expressor 20 is, effectively, a two stage device in the balancing of the loads and the like. As illustrated, expressor 20 has a rotor 21 with an axis of rotation A and eight symmetrically circumferentially spaced vanes which are designated V-1 through V-8, respectively. Vanes V-1 through V-8 may seal with the cylinder wall defined by cylinder 20-1 due to centrifugal force or, if necessary or desired, they may be spring biased into contact with the cylinder wall. A groove will be formed on the discharge side of each vane to prevent the cavity in the vane slot from trapping fluid and becoming a fluid spring. Cylinder 20-1 of expresser 20 has a uniform radius, relative to axis B. Line 22 and its port 22-1 are asymmetrical with respect to cavities C-4 and C-5 to reduce the inlet volume of the compressor of the expander 20, defined by sealed off cavity C-5 relative to the discharge volume of the expander of the expresser 20, defined by the greatest volume of cavity C-4, since the expander is feeding the evaporator 24 in addition to the compressor of expresser 20. Alternatively, the radius of cylinder 20-1 may vary so as to produce a smaller maximum volume in cavity C-5 than in cavity C-4.

Vane V-1 is illustrated as fully withdrawn into its slot in rotor 21 but in sealing contact with the wall of cylinder 20-1. The vane V-2 is slightly extended from its slot in rotor 21 and is in sealing contact with the wall of cylinder 20-1. The cavity C-1 defined between vanes V-1 and V-2 and rotor 21 and the wall of cylinder 20-1 is supplied with high pressure liquid (saturated or sub-cooled) refrigerant from the bottom of condenser 16 via line 18. Because the fluid pressure in cavity C-1 can act on a greater area of vane V-2 than of vane V-1, there is a force exerted by the fluid in cavity C-1 tending to move rotor 21 in a clockwise direction, as illustrated. The cavity C-2 is at an advanced stage in the expansion process relative to cavity C-1 and has a larger volume. Cavity C-1 is supplied with liquid refrigerant, although vaporous refrigerant may be supplied if cavity C-1 comes into communication with line 154 prior to moving out of communication with line 18. Cavity C-2 is in fluid communication with line 154 which supplies high pressure vapor to cavity C-2 as it increases in volume from first coming into contact with line 154 until moving out of contact with line 154. So, although cavity C-2 is larger than cavity C-1, the increased volume is supplied with vaporous refrigerant rather than due to flashing of the liquid refrigerant supplied to cavity C-2 when it was in the cavity C-1 position. Because the fluid pressure in cavity C-2 can act on a greater area of vane V-3 than of vane V-2, there is a force exerted by the fluid in cavity C-2 tending to move rotor 21 in a clockwise direction.

Cavity C-3 is at an advanced stage in the expansion process relative to cavity C-2 and has a larger volume. Because of the vaporous refrigerant supplied when cavity C-3 was in the cavity C-2 position, the expansion process can take place without the requirement of pre-throttling and the resultant loss of power/efficiency of the prior art devices. Because the fluid pressure in cavity C-3 can act on a greater area of vane V-4 than of vane V-3, there is a force exerted by the fluid in cavity C-3 tending to move rotor 21 in a clockwise direction. Cavity C-4 is at the end of the expansion process. As soon as vane V-5 is exposed to line 22, the low pressure liquid refrigerant from cavity C-4 is delivered to line 22 while a portion of the low pressure refrigerant gas flows past vane V-5 into cavity C-5. Typically, the refrigerant in cavity C-4 would be on the order of 70–86% in the liquid phase and the rest in the vaporous phase. The vapor phase portion of refrigerant entering cavity C-5 will be dictated by the specific refrigerant, the cycle, and the system configuration. For example, for refrigerant 134*a* the vapor mass flow rate being recompressed would be 6% of the total liquid mass flow rate entering the expressor 20 for a water cooled chiller and 10% for an air-cooled chiller. Typically, the vapor being recompressed would be at least 5% of the total liquid mass flow rate entering the expressor 20. The position of port 22-1 dictates the closing off of cavity C-5 and its initial volume. Assuming refrigerant 134*a* and a water cooled chiller, the vaporous refrigerant supplied to cavity C-5 is on the order of 6% of the total refrigerant from cavity C-4. Alternatively the radius of cylinder 20-1 may vary so as to produce a smaller maximum volume in cavity C-5 than in cavity C-4.

Cavity C-5 is at the first stage of the compression process and has a smaller volume than cavity C-4 when at their positions of maximum volume because of the position of port 22-1 or the reduced radius of the wall of cylinder 20-1 in the region of cavity C-5. The low pressures in cavities C-4 and C-5 will have minimal force exertion for rotating or resisting the rotation of rotor 21 compared to the other cavities, but the net force will be in a clockwise direction. Cavity C-6 represents a trapped volume of gaseous refrigerant being compressed in the early stages of compression. Because the fluid pressure in cavity C-6 acts on a greater area of vane V-6 than of vane V-7, there is a force exerted by the fluid in cavity C-6 tending to move rotor 21 in a counterclockwise direction. The reduced radius of the wall of cylinder 20-1, when present, reduces the exposure of vanes V-6 and V-7 to the fluid forces. The reduced volume being compressed prevents the canceling of the corresponding forces in the expander tending to move the rotor 21 in a clockwise direction.

Cavity C-7 is in the final stages of the compression process. Because the fluid pressure in cavity C-7 acts on a greater area of vane V-7 than of V-8, there is a force exerted by the compressed fluid in cavity C-7 tending to move rotor 21 in a counterclockwise direction. The higher pressure in chamber C-2 offsets this force so that rotor 21 rotates clockwise. Cavity C-8 is at the discharge stage of the compression process and is in communication with line 150 and is, nominally, at the discharge pressure of compressor 12. Cavity C-8 is in fluid communication with line 150 which supplies high pressure refrigerant to line 14. Additionally, line 150 supplies vaporous refrigerant at compressor discharge pressure to line 151 which is in continuous fluid communication with line 154 and cavity C-2 via restricted line 152. Line 151 is in selective communication with line 154 and cavity C-2 via line 153 which contains valve 160. Valve 160 may be any suitable type such as a solenoid valve which is pulsed to control the flow rate therethrough. Solenoid valve 160 is controlled by microprocessor 170 responsive to the liquid level in condenser 16 sensed by liquid level sensor 162.

In operation, hot high pressure refrigerant from compressor 12 is supplied via discharge line 14 to condenser 16 where the refrigerant vapor condenses to a liquid. Liquid refrigerant from the bottom of condenser 16 is supplied via line 18 to expressor 20 where it passes through the expansion process indicated by cavities C-1 through C-4. The low pressure liquid/vapor refrigerant mixture from cavity C-4 is supplied via line 22 to evaporator 24 where the liquid refrigerant evaporates to cool the required space and the resultant gaseous refrigerant is supplied to compressor 12 via suction line 26 to complete the cycle. Some of the refrigerant vapor from cavity C-4 is supplied to cavity C-5 of the compressor of the expresser 20. In the compression process sequentially illustrated by cavities C-5 through C-8 low pressure refrigerant vapor is compressed to a pressure corresponding to the discharge pressure of compressor 12 in discharge line 14. Cavity C-8 discharges into line 150 which delivers a portion of the high pressure gaseous refrigerant from cavity C-8 to line 14 where it effectively increases the amount of hot, high pressure refrigerant delivered to condenser 16 and thereby increases the capacity and efficiency of system 10. A portion of the high pressure vaporous refrigerant from cavity C-8 discharged into line 150 enters line 151 and passes via restricted line 152 into line 154 and into cavity C-2 that has just been disconnected from high pressure liquid refrigerant line 18 or is still connected to high pressure liquid refrigerant line 18 but is about to be disconnected. Restricted line 152 permits a flow of high pressure vaporous refrigerant into cavity C-2 at a rate associated with the minimum rotational speed of rotor 21. Line 153 is parallel to restricted line 152 and contains solenoid valve 160 which is controlled by microprocessor 170 responsive to the liquid level in condenser 16 sensed by liquid level sensor 162 in condenser 16. The speed of rotation of rotor 21 is increased by the degree of opening of valve 160. In addition to the expressor discharge, this high pressure vapor supplied to cavity C-2 can come from the discharge of compressor 12 via lines 14 and 150 for driving expressor 20 during start up. With refrigerant vapor present in the cavity C-2 portion of the expansion process, the expander can function properly and the mechanical power of the liquid-to-vapor expansion can be fully derived.

The high pressure liquid inlet port 18-1 leading from line 18 into cavity C-1 matches up the liquid-to-vapor expansion $V_i$ and the vapor feeding port 154-1 matches up the vapor expansion $V_i$ at the same pressure ratio. The high pressure vapor flow capacity controlled through valve 160 controls the rotational speed of the expressor 20. The minimum speed of rotor 21 and the minimum expansion flow capacity (refrigeration capacity of system 10) occurs when valve 160 is closed. Valve 160 is used to control the speed of rotor 21 which corresponds to the flow capacity of expressor 20. When valve 160 is fully open the speed of rotor 21 or the flow capacity of expressor 20 is at its maximum.

Normally the flow through line 150 during operation is from the discharge of the compressor portion of expressor 20 to discharge line 14. However, at start up, assuming that the pressure in system 10 has at least nominally equalized, a portion of the discharge of compressor 12 supplied to discharge line 14 may be supplied via line 150 to expressor 20. As is clear from FIG. 2 line 150 is in fluid communication with cavity C-8 where it will have little effect. However, line 150 is in fluid communication with cavity C-2 via lines 151, 152 and 154 such that, as described above, pressurized fluid in cavity C-2 tends to cause rotor 21 to rotate in a clockwise direction thereby facilitating start up of expressor 20.

Figure 3:
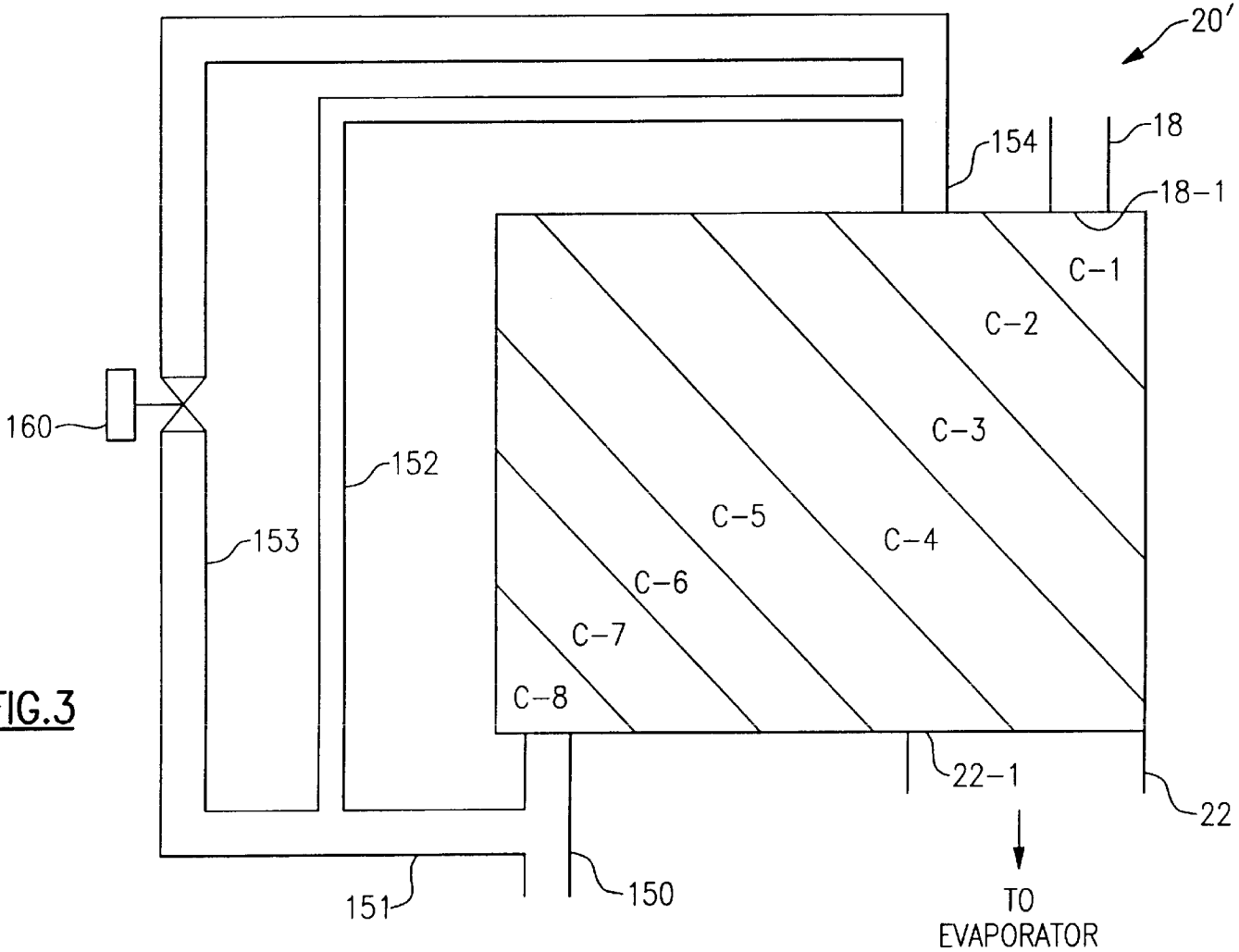
FIG. 3 is a simplified representation of the expresser of the FIG. 1 system where the expressor is a twin screw device.

Referring to FIG. 3, expressor 20' is the twin screw rotor equivalent of expressor 20. All of the structure of expressor 20' has been labeled the same as the equivalent structure of expressor 20. Although only one rotor 21' has been illustrated, it should be clear that cavities C-1 through C-4 progressively increase in volume to define the expander portion of the expressor and that cavities C-5 through C-8 progressively decrease in volume to define the compressor portion of the expander. The position of port 22-1 delays the closing of cavity C-5 and thereby reduces its maximum closed volume relative to the maximum closed volume of cavity C-4. If necessary, or desired, port 22-1 can delay the closing of the first trapped volume in the compression process such that it takes place in cavity C-6.

Figure 4:
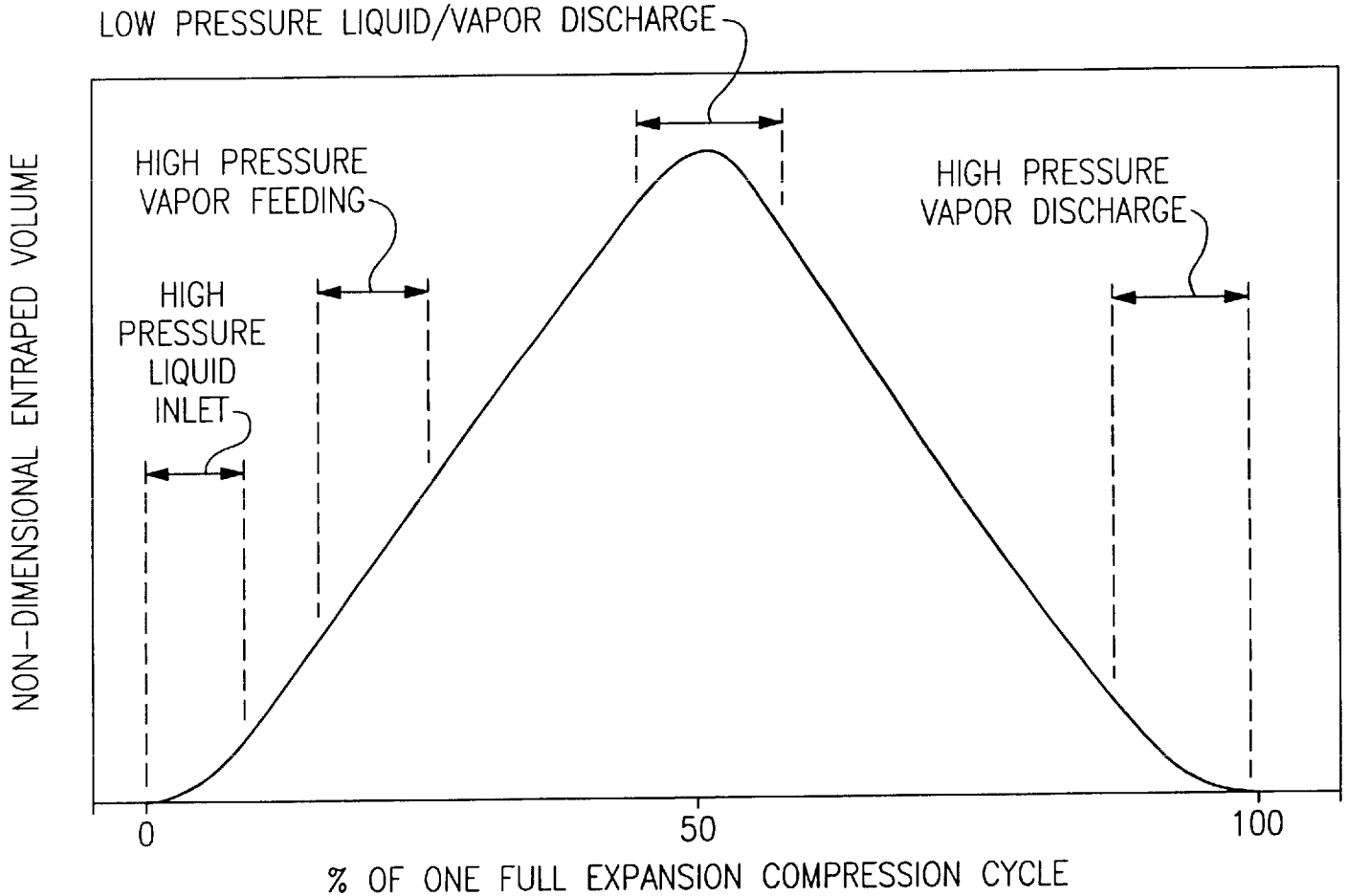
FIG. 4 is a graphical representation of the volumetric changes during the expansion and compression process in the expressor.

FIG. 4 is a graphical representation of the expansion and compression process in expressors 20 and 20' as the cavities progress from the cavity C-1 to the cavity C-8 positions described above. The central area designated low pressure liquid/vapor discharge corresponds to cavities C-4 and C-5 in their position illustrated in FIG. 2.

Although preferred embodiments of the present invention have been illustrated and described, other changes will occur to those skilled in the art. It is therefore intended that the scope of the present invention is to be limited only by the scope of the appended claims.

What is claimed is:

1. A closed refrigeration system serially including a main compressor, a discharge line, a condenser, an expressor, an evaporator and a suction line wherein:

said expressor has a portion which acts as an expander during one half of each cycle and a portion which acts as a compressor during the other half of each cycle;

said expander portion of said one half of each cycle including a plurality of trapped volumes of increasing volume which are sequentially connected to: means for supplying liquid refrigerant from said condenser; means for supplying discharge pressure from said compressor of said expresser; and means for exhausting to said evaporator and to said compressor of said expressor; and said compressor portion of said other half of each cycle including a plurality of trapped volumes which sequentially decrease in volume during said other half of each cycle.

2. The closed refrigeration system of claim 1 wherein the largest trapped volume in said expander portion is larger in volume than the largest trapped volume in said compressor portion.

3. The closed refrigeration system of claim 1 wherein said expressor is a rotary vane device.

4. The closed refrigeration system of claim 1 further including means for regulating said supplying of discharge pressure from said compressor portion of said expressor to trapped volumes of said expander portion.

5. The closed refrigeration system of claim 1 wherein said expressor is a screw device.

6. The closed refrigeration system of claim 1 further including means for connecting said discharge line to said expander portion during start up whereby said main compressor supplies pressurized refrigerant vapor to said expander portion for driving said expressor during start up conditions.

* * * * *